US008082987B2

(12) United States Patent
Chesnutt

(10) Patent No.: US 8,082,987 B2
(45) Date of Patent: Dec. 27, 2011

(54) HYDRAULICALLY LOCKING STABILIZER

(75) Inventor: Dennis Patrick Chesnutt, Houston, TX (US)

(73) Assignee: Smith International, Inc., Houston, TX (US)

( * ) Notice: Subject to any disclaimer, the term of this patent is extended or adjusted under 35 U.S.C. 154(b) by 356 days.

(21) Appl. No.: 12/496,109

(22) Filed: Jul. 1, 2009

(65) Prior Publication Data

US 2011/0000665 A1 Jan. 6, 2011

(51) Int. Cl.
*E21B 17/10* (2006.01)

(52) U.S. Cl. ..... 166/241.1; 175/325.1; 166/320

(58) Field of Classification Search ..... 166/241.1, 166/242.1; 175/325.1, 320
See application file for complete search history.

(56) References Cited

U.S. PATENT DOCUMENTS

| | | | | |
|---|---|---|---|---|
| 3,080,924 | A | 3/1963 | Baker et al. | |
| 3,131,769 | A | 5/1964 | Rochmont | |
| 3,305,021 | A | 2/1967 | Lebourg | |
| 3,448,805 | A | 6/1969 | Brown | |
| 3,599,712 | A | 8/1971 | Magill | |
| 4,377,207 | A | 3/1983 | Kofahl | |
| 4,681,160 | A | 7/1987 | Fineberg | |
| 4,693,328 | A | 9/1987 | Furse et al. | |
| 5,168,933 | A | 12/1992 | Pritchard, Jr. et al. | |
| 5,181,576 | A * | 1/1993 | Askew et al. | 175/61 |
| 5,293,945 | A | 3/1994 | Rosenhauch | |
| 5,379,838 | A | 1/1995 | Wilson et al. | |
| 5,417,288 | A | 5/1995 | Melenyzer et al. | |
| 5,603,386 | A * | 2/1997 | Webster | 175/76 |
| 6,019,182 | A | 2/2000 | Rountree et al. | |
| 6,173,786 | B1 | 1/2001 | Sampson et al. | |
| 6,257,356 | B1 * | 7/2001 | Wassell | 175/61 |
| 6,315,041 | B1 | 11/2001 | Carlisle et al. | |
| 6,419,024 | B1 | 7/2002 | George et al. | |
| 6,488,104 | B1 | 12/2002 | Eppink | |
| 6,497,288 | B2 | 12/2002 | George et al. | |
| 6,877,567 | B2 | 4/2005 | Hirth | |
| 7,143,848 | B2 | 12/2006 | Armell | |
| 7,188,689 | B2 | 3/2007 | Maxwell et al. | |
| 7,252,152 | B2 | 8/2007 | LoGiudice et al. | |

(Continued)

FOREIGN PATENT DOCUMENTS

GB 2381280 3/2006

OTHER PUBLICATIONS

International Search Report and Written Opinion dated Feb. 11, 2011 for corresponding PCT application No. PCT/US2010/040527 filed Jun. 30, 2010.

*Primary Examiner* — Kenneth L Thompson

(57) ABSTRACT

A downhole tool includes a pressure housing deployed in the bore of a drill collar. At least three fins are deployed on the housing and in the tool annulus. At least one of the fins includes a floating blade deployed thereon. The blade includes a plurality of radial pistons deployed therein. The pistons are configured such that the surface area of the radially outward facing piston surfaces is greater than the surface area of the radially inward facing piston surfaces. This piston configuration causes the surface area of the radially outward facing blade surface to be less than the radially inward facing blade surface. In operation, hydrostatic pressure exerts a differential force on the pistons and the floating blade thereby urging the pistons radially inward towards the housing and the blade radially outward towards the drill collar.

26 Claims, 6 Drawing Sheets

U.S. PATENT DOCUMENTS

| | | | | |
|---|---|---|---|---|
| 7,413,034 | B2 * | 8/2008 | Kirkhope et al. | 175/76 |
| 7,422,069 | B2 | 9/2008 | Richard et al. | |
| 7,503,398 | B2 | 3/2009 | LoGiudice et al. | |
| 7,681,665 | B2 * | 3/2010 | Eppink | 175/76 |
| 2002/0166664 | A1 | 11/2002 | Lauritzen et al. | |
| 2004/0237640 | A1 * | 12/2004 | Meister et al. | 73/152.48 |
| 2004/0244967 | A1 | 12/2004 | Armell | |
| 2004/0256113 | A1 | 12/2004 | LoGiudice et al. | |
| 2005/0224227 | A1 | 10/2005 | Hendrie | |
| 2006/0243435 | A1 | 11/2006 | Faul | |
| 2006/0272808 | A1 | 12/2006 | Doyle et al. | |
| 2008/0169107 | A1 | 7/2008 | Redlinger et al. | |
| 2008/0223573 | A1 | 9/2008 | Nelson et al. | |
| 2010/0276138 | A1 * | 11/2010 | Wittman et al. | 166/241.1 |

* cited by examiner

HYDRAULICALLY LOCKING STABILIZER

RELATED APPLICATIONS

None.

FIELD OF THE INVENTION

The present invention relates generally to downhole drilling operations and in particular to an apparatus for stabilizing and/or centralizing a pressure housing in a drill collar.

BACKGROUND OF THE INVENTION

In recent years there has been a marked increase in the sophistication of downhole tools, and in particular, downhole tools deployed in the bottom hole assembly (BHA) of a drill string. A typical BHA commonly includes, for example, one or more logging while drilling (LWD) and/or measurement while drilling (MWD) tools. Such tools are well known to include various electronic sensors such as gamma ray sensors, neutron sensors, resistivity sensors, formation pressure and temperature sensors, ultrasonic sensors, audio-frequency acoustic sensors, magnetic sensors, acceleration sensors, and the like. LWD and MWD tools typically further include an electronic controller including at least one microprocessor and electronic memory. Moreover, a typical BHA further includes other tools, such as a telemetry tool, a formation sampling tool, and/or a rotary steerable tool, which include electronic controllers disposed to control, monitor, and record various tool functions during drilling.

It is also well known in the art that severe dynamic conditions are often encountered during drilling. Commonly encountered dynamic conditions include, for example, bit bounce, lateral shock and vibration, and stick/slip. Bit bounce includes axial vibration of the drill string, often resulting in temporary lift off of the drill bit from the formation ("bouncing" of the drill bit off the bottom of the borehole). Lateral shocks and vibrations are those which are transverse to the axis of the drill string and are often due to impact of the BHA with the borehole wall. Stick/slip refers to a torsional vibration induced by friction between drill string components and the borehole wall. Stick/slip causes rapid rotational acceleration and deceleration of the drill string and is known to produce instantaneous drill string rotation speeds many times that of the nominal rotation speed of the table. Bit bounce, lateral shock and vibration, and stick/slip are commonly recognized as leading causes of electronic failures in downhole tools. These electronic failures often result in costly trips (tripping the drill string in and out of the borehole) to repair or replace damaged tools and/or tool components.

Due in part to the above described dynamic conditions, the use of electronic sensors and controllers in downhole tools poses no small challenge. Moreover, it is commonly desirable to deploy MWD sensors (e.g., accelerometers, magnetometers, and gyroscopes) and certain LWD sensors (e.g., gamma ray sensors, neutron sensors, and density sensors) as close as possible to the longitudinal axis of the drill string. These sensors are typically deployed in a pressure housing that is centralized in the bore of a drill collar. In such configurations, it is typically desirable for the pressure housing to be both securely fixed to the drill collar and easily removable from the drill collar (e.g., for servicing the sensors between drilling operations). The centralizing mechanism should also be streamlined so as to enable drilling fluid to flow through the annulus between the inner surface of the drill collar and the outer surface of the pressure housing with minimal restriction.

Various centralizer configurations are known in the art. For example, one type of centralizer includes a pressure housing having metallic fins and/or rings sized and shaped to nearly contact the inner wall of the drill collar. This configuration may also employ o-rings for vibration dampening. While such an arrangement tends to adequately centralize the pressure housing(s), the necessary gap between the fins and drill collar tends to damage the inner surface of the collar under vibration and can actually amplify the shock and vibration seen by the electronics. Moreover, removal of the centralizer can be problematic due to mud packing between the ring and collar ID.

Another adaption of the metal finned or ring-type centralizer incorporates a wedge-locking device. These wedge-locking devices are typically energized using conventional screws. These devices often provide adequate locking and centralization of the pressure housing(s). However the screws have been known to loosen in service thereby unlocking the device and allowing motion of the device due to the downhole dynamic conditions. The screws have even been known to completely unscrew and fall down through the BHA to the bit where they can plug nozzles and causes drilling problems.

Another commercially available configuration utilizes molded rubber fins which are sized and shaped for a slight interference fit with the ID of the drill collar. While this arrangement tends to adequately dampen vibrations, installation and removal of the centralizer can be problematic due to the high coefficient of friction between rubber and steel. Moreover, the rubber fins are susceptible to tearing and chemical degradation which can lead to excessive movement of the pressure housings in service.

Pressure actuated, wedge locking centralizers are also known in the art. While such pressure actuated wedging mechanisms (provided by an inclined plane) increase the mechanical holding force of the stabilizer in the drill collar they tend to be bulky and therefore tend to significantly restrict the flow of drilling fluid through the drill collar. This restriction increases local fluid velocity and turbulence which in turn can lead to serious erosion and cavitation damage to the drill collar and pressure housing. Wedging mechanisms are further problematic in that a significant portion of the force exerted by the piston can be needed just to overcome the frictional forces between the wedge and the ramp and the movement needed between the wedge and the collar. The wedge style approach can also be problematic when trying to remove the system from the collar due to friction locking.

Therefore, there is a need in the art for an improved centralizer, for example, for centralizing and/or stabilizing pressure housings in a drill collar.

SUMMARY OF THE INVENTION

The present invention addresses one or more of the above-described shortcomings of prior art stabilizers for use in downhole tools. Aspects of this invention include a downhole tool having a pressure housing deployed in the bore of a drill collar. The pressure housing may include, for example, one or more MWD or LWD sensors deployed therein. At least three circumferentially spaced fins are deployed on the housing and in the annulus between an outer surface of the housing and an inner surface of the drill collar. In the preferred configuration two of the fins are rigid and configured to physically contact the drill collar and thereby stabilize and/or centralize the housing in the collar. A floating blade is deployed on the third fin. The blade includes a plurality of radial pistons deployed therein. The pistons are configured such that the surface area of the radially outward facing piston surfaces is greater than the surface area of the radially inward facing piston surfaces. This piston configuration causes the surface area of the radially outward facing blade surface to be less than the radially inward facing blade surface.

In operation, these surface area differences cause a differential force to be applied to the pistons and the blade when the tool is deployed in a subterranean borehole. In particular, the pistons are urged radially inward towards the housing and the blade is urged radially outward towards the drill collar under the influence of hydrostatic pressure. This stabilizing force tends to be directly proportional to the hydrostatic pressure.

Exemplary embodiments of the present invention advantageously provide several technical advantages. For example exemplary embodiments of this invention provide a strong stabilizing force between the pressure housing and the drill collar when the downhole tool is deployed in a subterranean borehole. Moreover, the use of radial pistons minimizes frictional losses. The invention also enables easy removal of the pressure housing from the drill collar when the tool has been removed from the borehole.

Certain embodiments of the invention, for example those employing longitudinally spaced and circumferentially aligned radial pistons, are further advantageous in that they tend to impart minimal obstruction to the flow of drilling fluid through the tool annulus while also providing a strong stabilizing force to the housing. Enabling unobstructed fluid flow advantageously reduces erosion, which in turn can extend the service life of the downhole tool.

In one aspect this invention includes a downhole tool. The tool includes a substantially cylindrical drill collar having a longitudinal bore and a housing deployed in the bore. At least three axial fins are deployed on the housing. A floating blade is deployed on at least one of the fins. The floating blade is configured to extend radially outward into contact with an inner surface of the drill collar. The floating blade has radially inward and radially outward facing blade surfaces. The surface area of the radially inward facing blade surface is greater than the surface area of the radially outward facing blade surface. A plurality of radial pistons is deployed in the blade. Each of the pistons has corresponding radially inward and radially outward facing piston surfaces. The surface area of the radially inward facing piston surfaces is less than the surface area of the radially outward facing piston surfaces.

In another aspect, this invention includes an apparatus for stabilizing a pressure housing in a drill collar. The apparatus includes at least three axial fins deployed on the housing. A floating blade is deployed on at least one of the fins. The floating blade is configured to extend radially outward into contact with an inner surface of the drill collar. The floating blade has radially inward and radially outward facing blade surfaces. The surface area of the radially inward facing blade surface is greater than the surface area of the radially outward facing blade surface. A plurality of radial pistons is deployed in the blade. Each of the pistons has corresponding radially inward and radially outward facing piston surfaces. The surface area of the radially inward facing piston surfaces is less than the surface area of the radially outward facing piston surfaces.

The foregoing has outlined rather broadly the features and technical advantages of the present invention in order that the detailed description of the invention that follows may be better understood. Additional features and advantages of the invention will be described hereinafter, which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
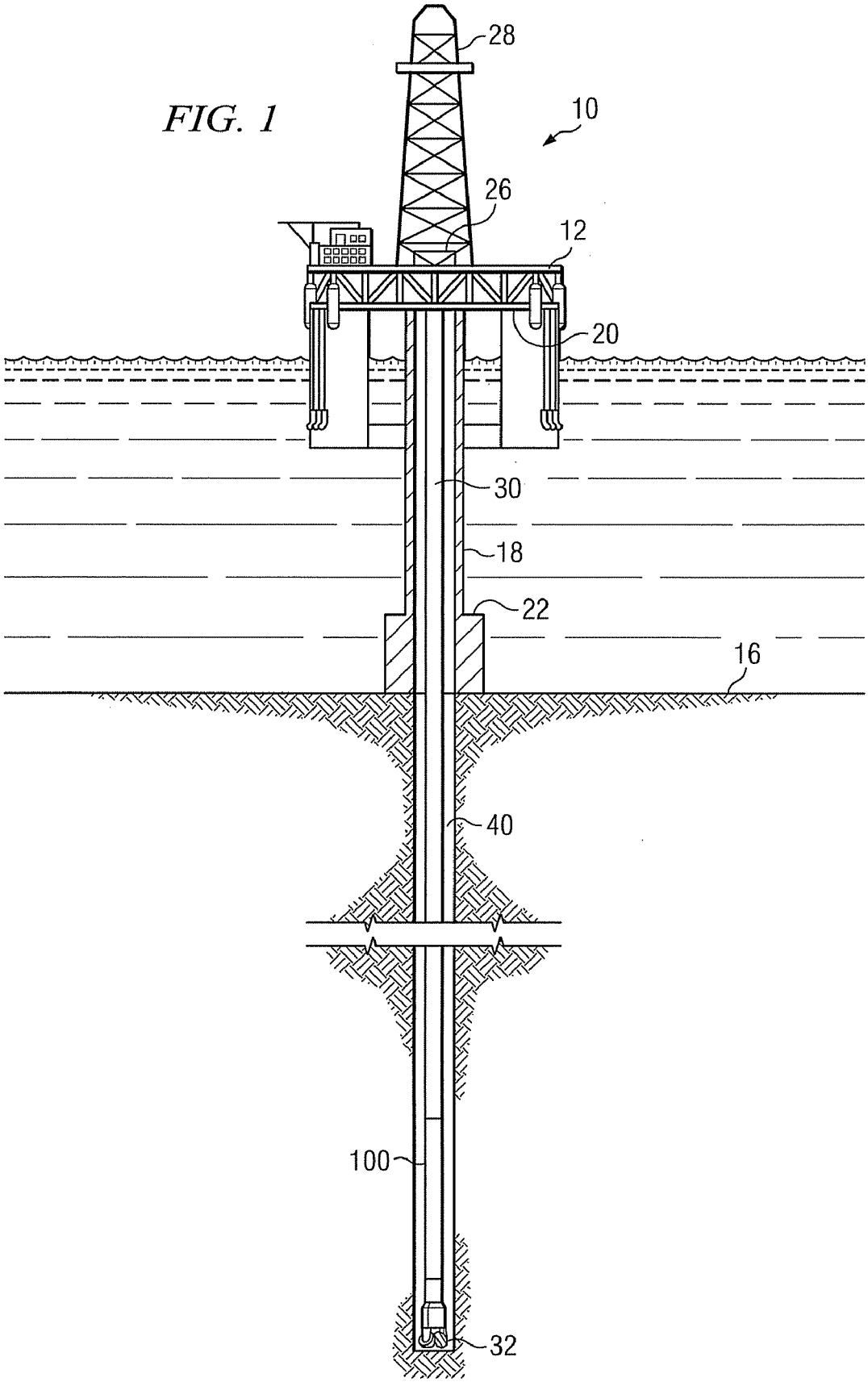
FIG. 1 depicts a drilling rig on which exemplary embodiments of the present invention may be deployed.

Referring first to FIGS. 1 through 6, it will be understood that features or aspects of the exemplary embodiments illustrated may be shown from various views. Where such features or aspects are common to particular views, they are labeled using the same reference numeral. Thus, a feature or aspect labeled with a particular reference numeral on one view in FIGS. 1 through 6 may be described herein with respect to that reference numeral shown on other views.

FIG. 1 illustrates a drilling rig 10 suitable for the deployment of exemplary embodiments of the present invention. In the exemplary embodiment shown on FIG. 1, a semisubmersible drilling platform 12 is positioned over an oil or gas formation (not shown) disposed below the sea floor 16. A subsea conduit 18 extends from deck 20 of platform 12 to a wellhead installation 22. The platform may include a derrick 26 and a hoisting apparatus 28 for raising and lowering the drill string 30, which, as shown, extends into borehole 40 and includes a drill bit 32 and a downhole tool 100 (e.g., an MWD tool). As described in more detail below with respect to FIGS. 2 through 6, downhole tool 100 includes a pressure housing (not shown on FIG. 1) deployed in a conventional drill collar. The pressure housing commonly includes one or more electronic sensors and/or other electronic devices; however, the invention is not limited in these regards.

It will be understood by those of ordinary skill in the art that the invention is not limited to use with a semisubmersible platform 12 as illustrated in FIG. 1. This invention is equally well suited for use with any kind of subterranean drilling operation, either offshore or onshore. While exemplary embodiments of this invention are sometimes described below with respect to MWD embodiments, it will be appreciated that the invention is not limited in this regard. For example, as described in more detail below, embodiments of the invention may also be utilized in substantially any downhole tool configuration in which a housing is centralized and/or stabilized in a drill collar. The invention may therefore also be utilized, for example, in LWD tools, battery subs, communication subs, and the like.

Figure 2:
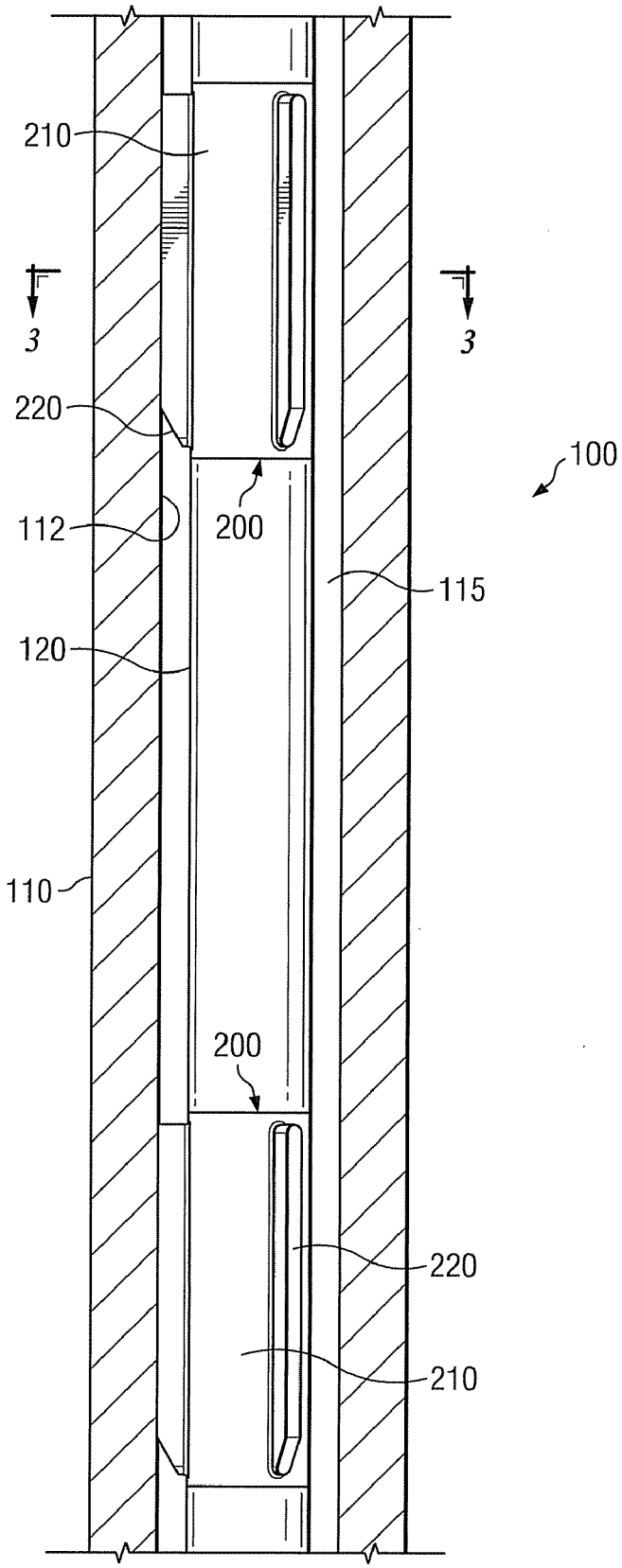
FIG. 2 depicts a longitudinal cross section of one exemplary embodiment of the downhole tool shown on FIG. 1.

Turning now to FIG. 2, downhole tool 100 is shown in longitudinal cross section. In the exemplary embodiment shown, tool 100 includes a tubular tool body 110 (a drill collar). The tool body 110 typically includes threaded ends (e.g., pin and box ends—not shown) for coupling with other BHA components, although the invention is not limited in this regard. The tool further includes a pressure housing 120 deployed in the tool body 110. Pressure housing 120 is configured to provide a pressure tight seal for electronic sensors and other electronic components deployed therein. In the exemplary embodiment shown, the pressure housing 120 is centralized and stabilized in the tool body (i.e., deployed coaxially with the tool body) via first and second hydraulically locking centralizers 200, although the invention is not limited to the use of any particular number of stabilizers.

In the exemplary embodiment depicted, the inventive centralizer 200 includes a sleeve 210 having three or more radial fins 220. The sleeve 210 is deployed about a tandem sub 150 which is in turn connected to the pressure housing 120. The fins are configured to contact and apply force to the inner surface 112 of the tool body 110 and thereby stabilize the pressure housing 120 in the drill collar. As described in more detail below with respect to FIGS. 4 through 6, at least one of the fins includes a floating blade 250 (not shown on FIG. 2) configured to extend radially outward from the housing into contact with the inner surface 112 of the tool body 110.

In the exemplary embodiment depicted on FIG. 2, pressure housing 120 is centralized in the tool body 110. Moreover, the corresponding fins 220 in the first and second centralizers 200 are circumferentially aligned with one another (i.e., they are oriented at the same toolface angle). It will be appreciated that the invention is not limited in these regards. For example, in embodiments in which the pressure housing 120 is centralized in the tool body 110, the fins 220 need not be circumferentially aligned. Centralizers in accordance with the present invention may also be utilized to eccenter pressure housing 120 in the tool body 110. In such eccentric embodiments, the corresponding fins are typically circumferentially aligned.

Figure 3:
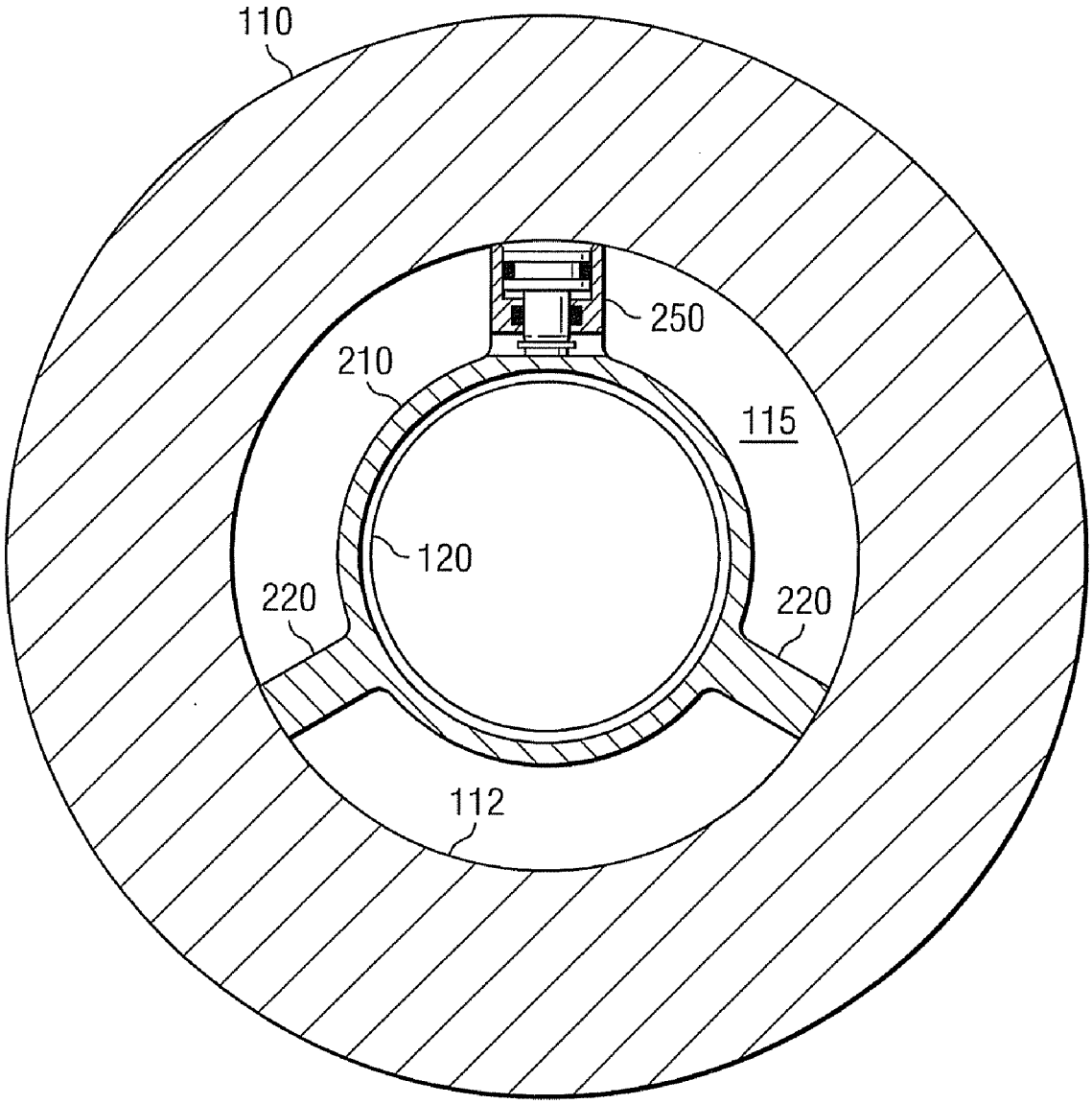
FIG. 3 depicts a circular cross section of the downhole tool shown on FIG. 2.

Turning now to FIG. 3, downhole tool 100 is shown in circular cross section through the upper stabilizer 200. As depicted, stabilizer 200 includes three fins 220, at least one of which further includes a floating blade 250 which is shown to be extended into contact with the inner surface 112 of tool body 110. In the exemplary embodiment depicted, the fins 220 are integral with the sleeve 210 (i.e., the sleeve 210 and fins 220 are of a unitary construction). The invention is expressly not limited in this regard. For example, in one alternative embodiment the fins 220 may be fastened (e.g., via conventional screws) to the sleeve. In still another alternative embodiment the fins 220 may be fastened directly to the pressure housing 120. Those of ordinary skill in the art will readily appreciate that these alternative embodiments may advantageously reduce the fabrication cost of centralizers/stabilizers in accordance with present invention, by eliminating (or reducing) the need for complex machining operations.

With continued reference to FIG. 3, the fins 220 are preferably, although not necessarily, in-gauge (i.e., matched to the bore ID) to provide accurate centralization of the pressure housing 120. The fins 220 are further advantageously sized and shaped so as to be streamlined (i.e., to be long and thin, or thought of another way, to have a high length to width ratio). Such streamlined fins advantageously have a small area in circular cross section as compared to the cross sectional area of the annulus 115. Such a structure advantageously minimizes the obstruction to drilling fluid flow through the tool annulus 115, which in turn tends to reduce erosion.

Figure 4:
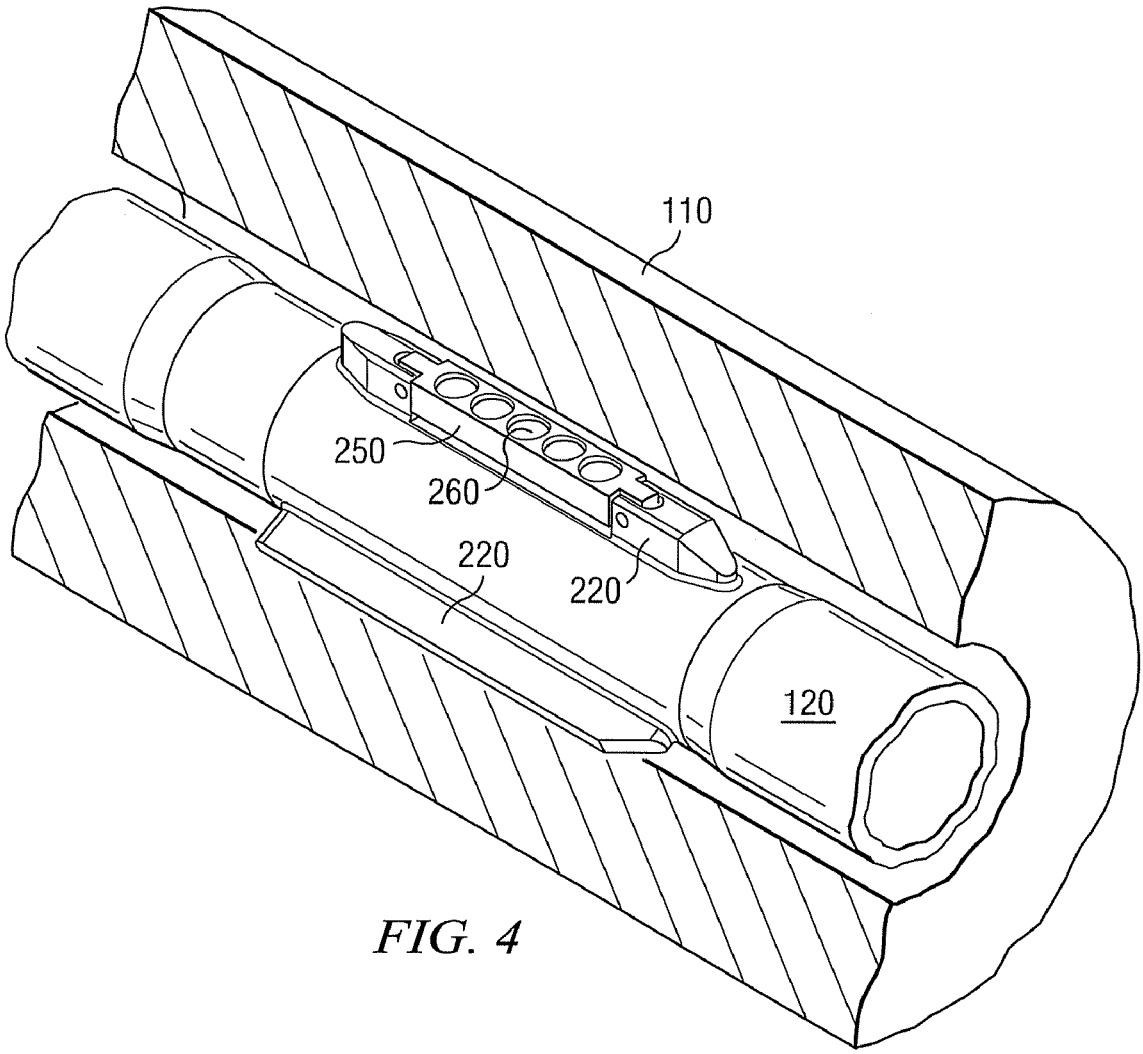
FIG. 4 depicts a perspective view of one of the hydraulically actuated stabilizers shown on FIG. 2.
Figure 5:
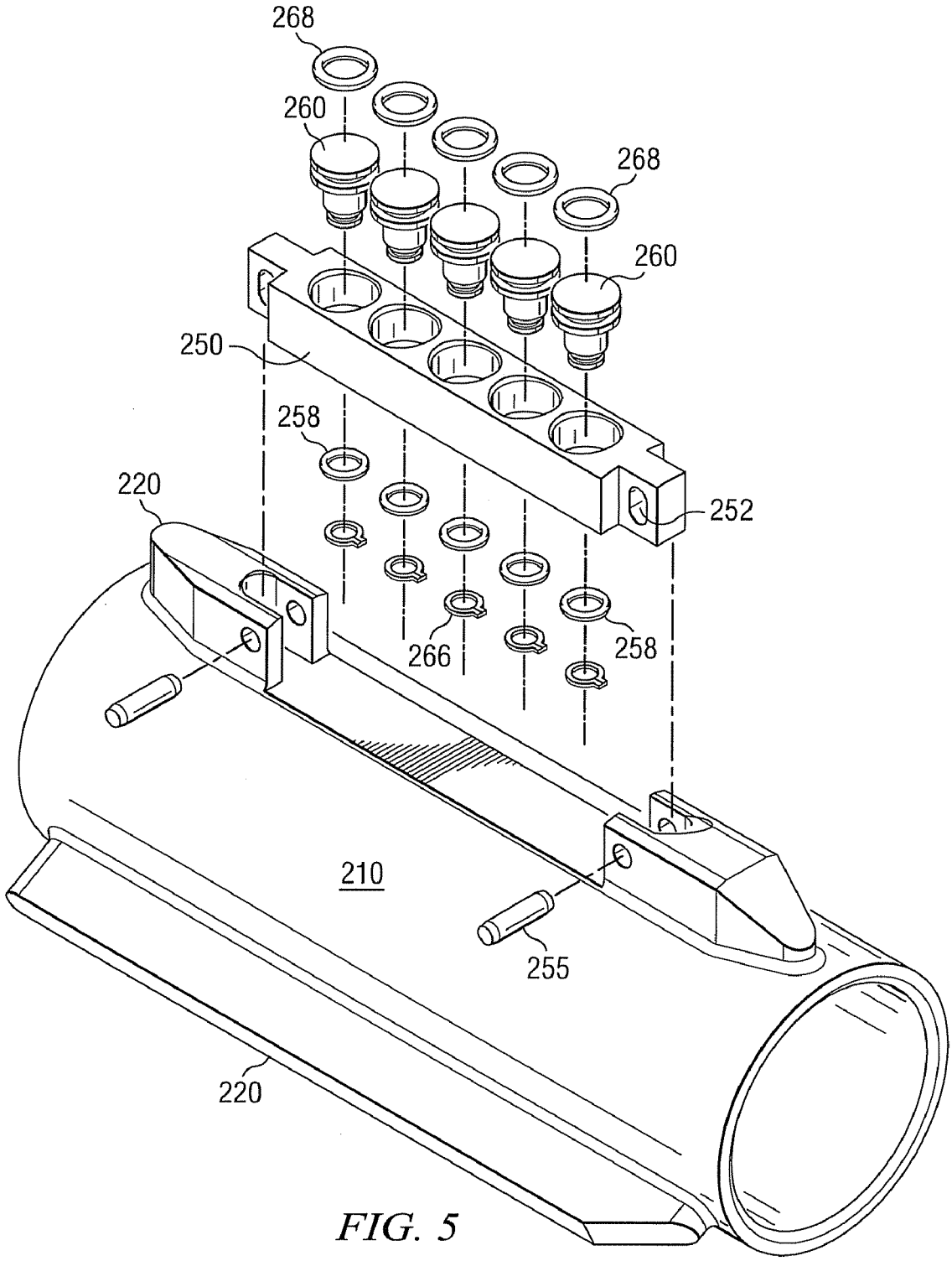
FIG. 5 depicts an exploded view of the stabilizer shown on FIG. 4.
Figure 6:
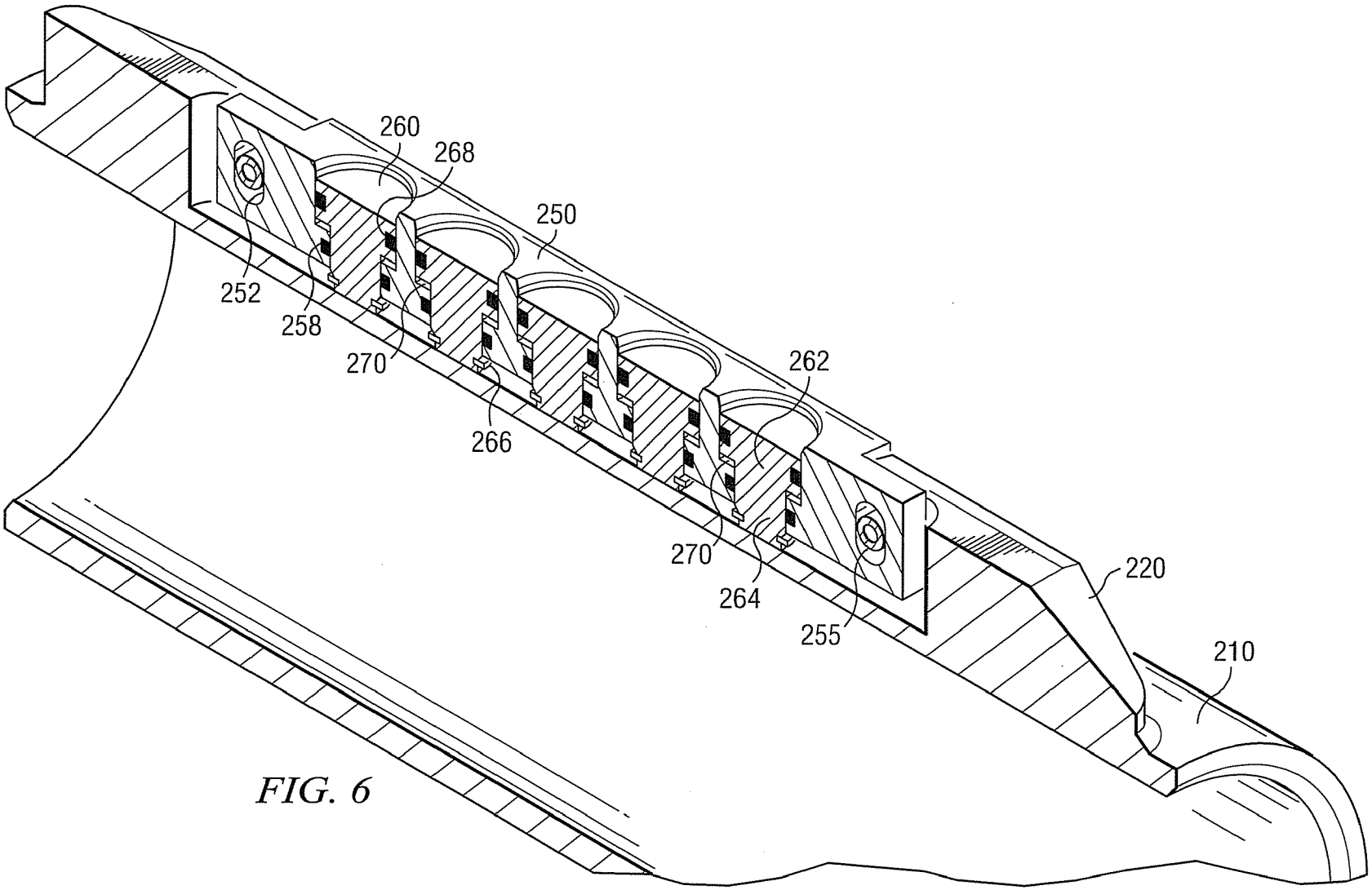
FIG. 6 depicts a longitudinal cross section of the stabilizer shown on FIG. 4.

With reference now to FIGS. 4-6, the structure and function of one advantageous embodiment of floating blade 250 is described in more detail. FIG. 4 depicts the stabilizer 200 in perspective view, while FIG. 5 depicts an exploded view. FIG. 6 depicts a longitudinal cross section through the blade 250. As shown, at least one of the fins 220 includes a floating blade 250 which is configured to extend radially outward into contact with an inner surface of the tool body 110. The blade 250 is also configured to apply a radial force (a stabilizing force) to the tool body 110. In the exemplary embodiment depicted, the blade 250 is secured to the corresponding fin 220 via first and second longitudinally opposed retaining pins 255. The blade 250 is configured to "float" in the radial direction on the pins 255, which extend through corresponding radial slots 252 formed on the blade ends. This configuration secures the blade 250 to the fin 220 while at the same time allowing the blade 250 to extend and retract in a radial direction.

A plurality of radial pistons 260 (preferably 4 or more) are deployed in corresponding recesses in the blade 250. In the exemplary embodiment shown, the pistons 260 are both longitudinally (axially) spaced and circumferentially aligned. This configuration in which the pistons 260 are longitudinally spaced and circumferentially aligned advantageously enables the use of a long, slender blade 250, which minimizes obstruction to the flow of drilling fluid as described above. The use of multiple (e.g., 4 or more) pistons 260 advantageously increases the magnitude of the radial force that may be applied to the blade 250, which in turn tends to improve the stabilization of the pressure housing 120. Moreover, the use of multiple pistons 260 is further advantageous in that it provides redundancy and improved tool reliability in service. Longitudinally spacing and/or circumferentially aligning the pistons 260 advantageously enables multiple pistons to be employed while also ensuring minimal fluid flow obstruction. As further depicted, the pistons 260 and blade 250 are configured to reciprocate with respect to one another in a substantially purely radial direction. This obviates the need for the use of a wedging mechanism and advantageously enables the blade motion to be purely radial.

With reference now to FIG. 6, each piston 260 includes a relatively large diameter base 262 facing radially outward and a relatively small diameter neck 264 facing radially inward. Each piston further defines a corresponding annular chamber 270 located about the neck 264 between first and second radially spaced o-ring seals 258 and 268. The o-ring seals 258 and 268 sealingly engage each of the pistons 260 with the blade 250 and therefore provide a substantially pressure tight seal between the chamber 270 and the annulus 115. In the exemplary embodiment depicted, each of the pistons further includes a retaining ring 266 deployed about the neck 264 for securing the piston 260 in the blade 250.

As described above, stabilizer 200 is configured for hydrostatic pressure actuation. As is known to those of ordinary skill in the art, the annulus 115 fills with drilling fluid upon deployment of downhole tool 100 in a borehole, with the hydrostatic pressure of the drilling fluid increasing with increasing total vertical depth of the borehole. As depicted in FIG. 4, the drilling fluid in the annulus surrounds the floating blade 250 (i.e., the drilling fluid readily accesses the underside of the blade 250). As the tool 100 is lowered in the borehole and the hydrostatic pressure increases above atmospheric pressure, a differential force urges the blade 250 outward into contact with tool body 110. This differential force is due to the differential surface area between the inner and outer surfaces of the pistons 260 and blade 250. In particular, as described above, each of the pistons has a relatively large diameter base 262 facing radially outward and a relatively small diameter neck 264 facing radially inward. Therefore the piston surface area facing radially outward is greater than the piston surface area facing radially inward. Since the pistons 260 are deployed in the blade 250, the surface area of the blade surface that faces radially outward is less than the surface area facing radially inward. These surface area differences result in corresponding differential forces that urge the pistons 260 radially inward into contact with the sleeve 210 (or the pressure housing 120 in embodiments not utilizing a sleeve) and the blade 250 radially outward into contact with drill collar 110 thereby compressing chamber 270. Those of skill in the art will readily appreciate that these differential forces (and therefore the force on the blade) are proportional to the hydrostatic pressure of the drilling fluid. Those of ordinary skill will also appreciate that the proportionality constant tends to increase as the area ratio of the base 262 to the neck 264 increases. In the exemplary embodiment depicted, the outward force on the blade 250 is about 500 pounds per 1000 psi hydrostatic pressure. The invention is, of course, not limited in regard to such a proportionality constant.

Upon removal of the tool 100 from the borehole, the pressure housing 120 and stabilizer(s) 200 may be readily removed from the drill collar 110. In the absence of hydrostatic pressure, the blade 250 floats on retaining pins 255 and therefore advantageously offers little (or no) resistance to such removal. The fins 220 being slightly under-gauge or in-gauge slide freely out of the collar 110.

Although the present invention and its advantages have been described in detail, it should be understood that various changes, substitutions and alternations can be made herein without departing from the spirit and scope of the invention as defined by the appended claims.

I claim:

1. A downhole tool comprising:

a substantially cylindrical drill collar having a longitudinal bore;

a housing deployed in the bore;

at least three axial fins deployed on the housing;

a floating blade deployed on at least one of the fins, the floating blade being configured to extend radially outward into contact with an inner surface of the drill collar, the floating blade having radially inward and radially outward facing blade surfaces, a surface area of the radially inward facing blade surface being greater than a surface area of the radially outward facing blade surface; and a plurality of radial pistons deployed in the blade, each of the pistons having corresponding radially inward and radially outward facing piston surfaces, a surface area of the radially inward facing piston surfaces being less than a surface area of the radially outward facing piston surfaces.

2. The downhole tool of claim 1, wherein the pistons are longitudinally spaced in the blade and circumferentially aligned with one another.

3. The downhole tool of claim 1, comprising at least four of the pistons.

4. The downhole tool of claim 1, wherein the blade is secured on the at least one fin via first and second pins that pass through corresponding first and second radial slots formed on opposing longitudinal ends of the blade.

5. The downhole tool of claim 1, wherein each of the pistons is sealingly engaged with the blade.

6. The downhole tool of claim 1, wherein each of the pistons defines a corresponding annular chamber located about a neck portion of the piston.

7. The downhole tool of claim 6, wherein each annular chamber is located between first and second radially spaced o-ring seals deployed about the piston.

8. The downhole tool of claim 1, wherein the fins are deployed substantially equi-angularly about a circumference of the housing.

9. The downhole tool of claim 1, wherein the fins are fastened directly to the housing.

10. The downhole tool of claim 1, wherein the fins are deployed on a sleeve, the sleeve being deployed about the housing.

11. The downhole tool of claim 1, wherein the radially inward facing blade surface and the radially outward facing blade surface are in fluid communication with an annulus between the housing and the drill collar.

12. The downhole tool of claim 1, wherein the radially inward facing piston surfaces and the radially outward facing piston surfaces are in fluid communication with an annulus between the housing and the drill collar.

13. A downhole tool comprising:

a substantially cylindrical drill collar having a longitudinal bore;

a housing deployed in the bore;

first and second longitudinally spaced stabilizers deployed on the housing; each of the stabilizers including at least three elongated fins, at least one of the fins including a floating blade configured to extend radially outward into contact with an inner surface of the drill collar, the floating blade having radially inward and radially outward facing blade surfaces, a surface area of the radially inward facing blade surfaces being greater than a surface area of the radially outward facing blade surfaces;

each of the stabilizers further including a plurality of radial pistons deployed in the blade, each of the pistons having corresponding radially inward and radially outward facing piston surfaces, a surface area of the radially inward facing piston surfaces being less than a surface area of the radially outward facing piston surfaces.

14. The downhole tool of claim 13, wherein the pistons are longitudinally spaced in the blades and circumferentially aligned with one another.

15. The downhole tool of claim 13, wherein each of the stabilizers comprises at least four pistons.

16. The downhole tool of claim 13, wherein the blades are secured on the corresponding fin via first and second pins that pass through corresponding first and second radial slots formed on opposing longitudinal ends of the blade.

17. The downhole tool of claim 13, wherein each of the pistons is sealingly engaged with the corresponding blade via first and second radially spaced o-ring seals, the seals defining a corresponding annular chamber located about a neck portion of the piston.

18. The downhole tool of claim 13, wherein the fins are fastened directly to the housing.

19. The downhole tool of claim 13, wherein:

the radially inward facing blade surface and the radially outward facing blade surface are in fluid communication with an annulus between the housing and the drill collar; and the radially inward facing piston surfaces and the radially outward facing piston surfaces are in fluid communication with the annulus.

20. An apparatus for stabilizing a pressure housing in a drill collar, the apparatus comprising:

at least three axial fins deployed on the housing;

a floating blade deployed on at least one of the fins, the floating blade being configured to extend radially outward into contact with an inner surface of the drill collar, the floating blade having radially inward and radially outward facing blade surfaces, a surface area of the radially inward facing blade surface being greater than a surface area of the radially outward facing blade surface; and a plurality of radial pistons deployed in the blade, each of the pistons having corresponding radially inward and radially outward facing piston surfaces, a surface area of the radially inward facing piston surfaces being less than a surface area of the radially outward facing piston surfaces.

21. The apparatus of claim 20, wherein the pistons are longitudinally spaced in the blades and circumferentially aligned with one another.

22. The apparatus of claim 20, wherein each of the stabilizers comprises at least four pistons.

23. The apparatus of claim 20, wherein the blades are secured on the corresponding fin via first and second pins that pass through corresponding first and second radial slots formed on opposing longitudinal ends of the blade.

24. The apparatus of claim 20, wherein each of the pistons is sealingly engaged with the corresponding blade via first and second radially spaced o-ring seals, the seals defining a corresponding annular chamber located about a neck portion of the piston.

25. The apparatus of claim 20, wherein the fins are fastened directly to the housing.

26. The apparatus of claim 20, wherein:

the radially inward facing blade surface and the radially outward facing blade surface are in fluid communication with an annulus between the housing and the drill collar; and the radially inward facing piston surfaces and the radially outward facing piston surfaces are in fluid communication with the annulus.

* * * * *